US006028614A

United States Patent [19]

Clark

[11] Patent Number: 6,028,614

[45] Date of Patent: Feb. 22, 2000

[54] CLEANING AND LAPPING APPARATUS AND METHOD FOR ELECTROGRAPHIC PRINTERS

[76] Inventor: Lloyd Douglas Clark, 15 Conrad St., San Francisco, Calif. 94131

[21] Appl. No.: 08/970,034

[22] Filed: Nov. 13, 1997

[51] Int. Cl.[7] ..... B41J 2/385

[52] U.S. Cl. ..... 347/112; 347/154

[58] Field of Search ..... 347/112, 141, 347/153, 154; 400/701

[56] References Cited

U.S. PATENT DOCUMENTS

| | | | |
|---|---|---|---|
| 3,752,288 | 8/1973 | Detig et al. | 400/322 |
| 4,638,339 | 1/1987 | Coburn et al. | 347/154 |
| 4,862,198 | 8/1989 | Rizza et al. | 347/141 |
| 5,875,719 | 3/1999 | Francis | 101/424 |

*Primary Examiner*—Joan Pendegrass

[57] ABSTRACT

For cleaning the print heads of an electrographic printer, a cleaning strip (900) or a lapping strip (1000) is applied to a medium (10) which moves through the printer. The strip (900 or 1000) is first positioned between fiducial marks printed on the medium (10). Then a solvent or other "conditioning agent" is optionally applied to the strip. Then the strip is moved backward into the printer and positioned over at least one electrographic print head (40). The medium (10) is optionally moved back and forth and/or the print head (40) is optionally moved back and forth. This action accomplishes cleaning or lapping of the electrographic print head. After use, the strip, still affixed to the medium (10) is moved away from the printing area and printing resumes. The process is equally applicable in single-pass and multi-pass printers.

21 Claims, 10 Drawing Sheets

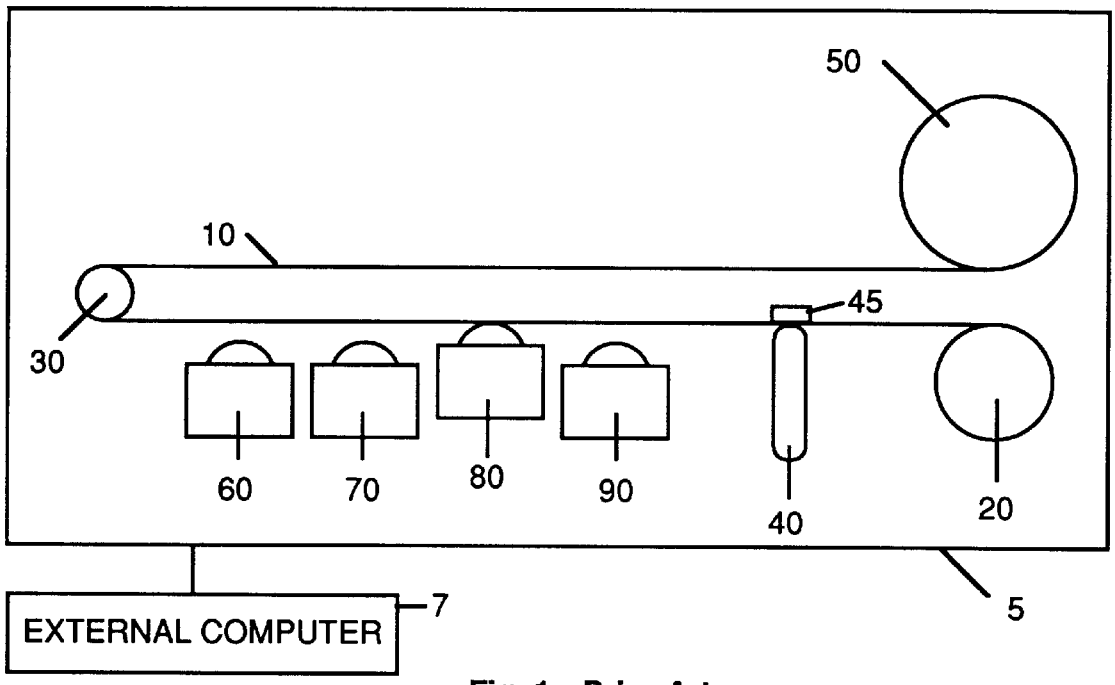
Fig. 1—Prior Art
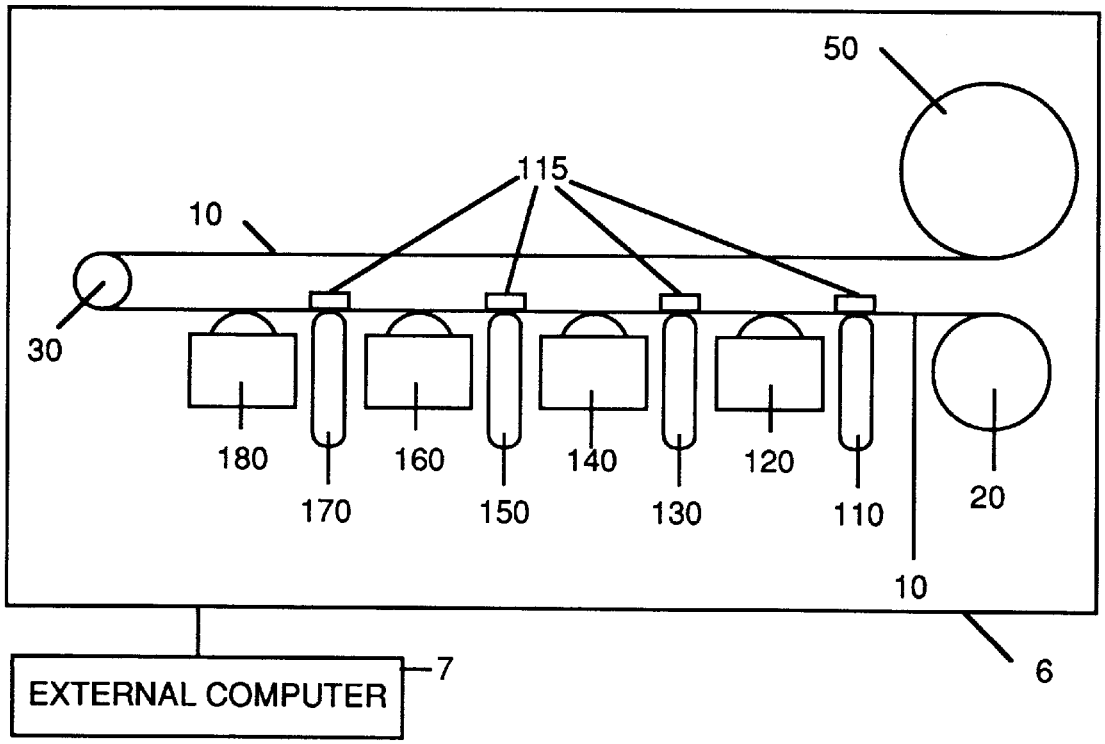
Fig. 2—Prior Art

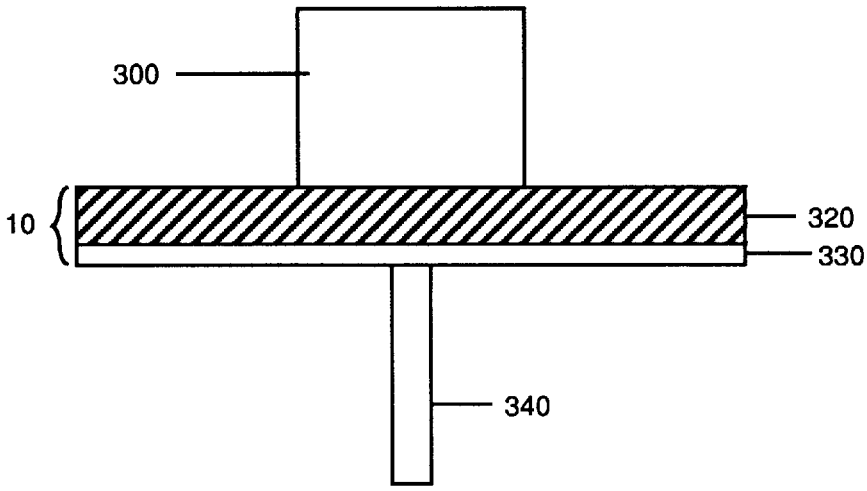
Fig. 3—Prior Art
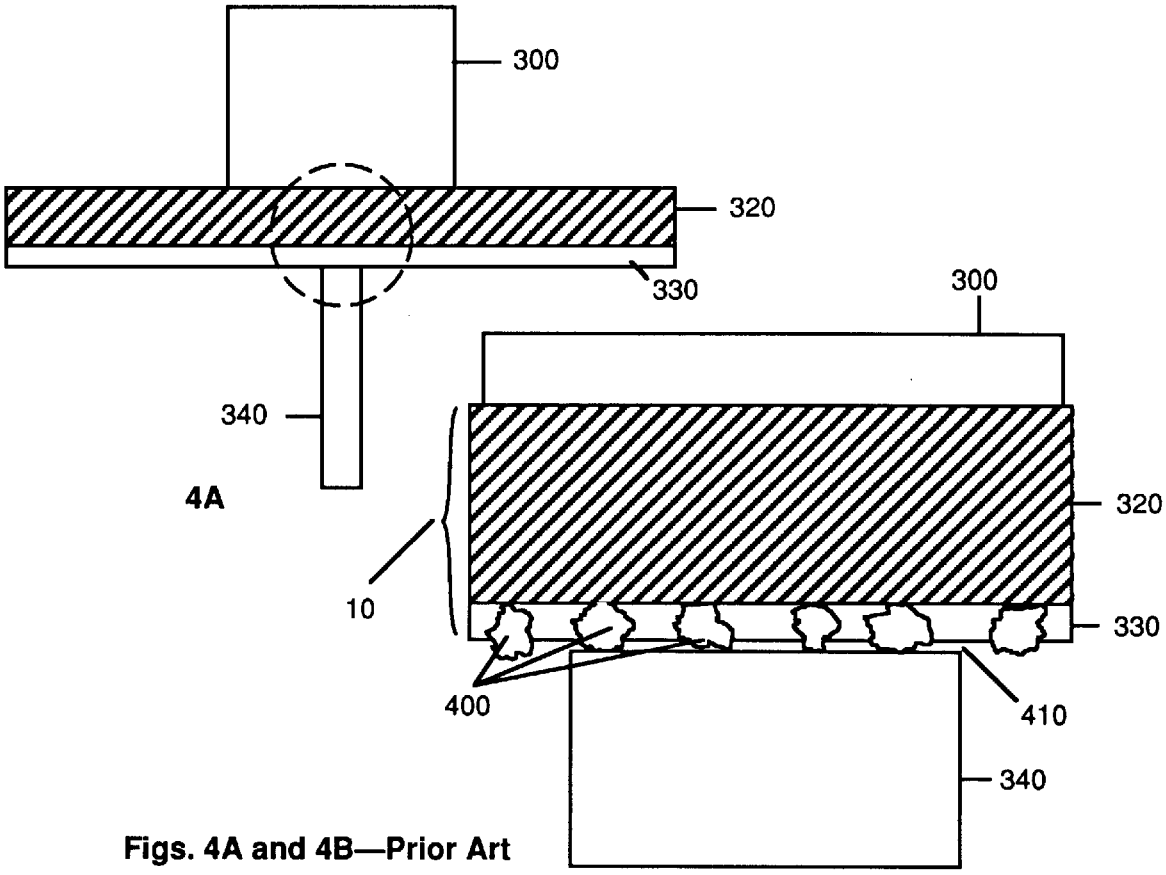
Figs. 4A and 4B—Prior Art

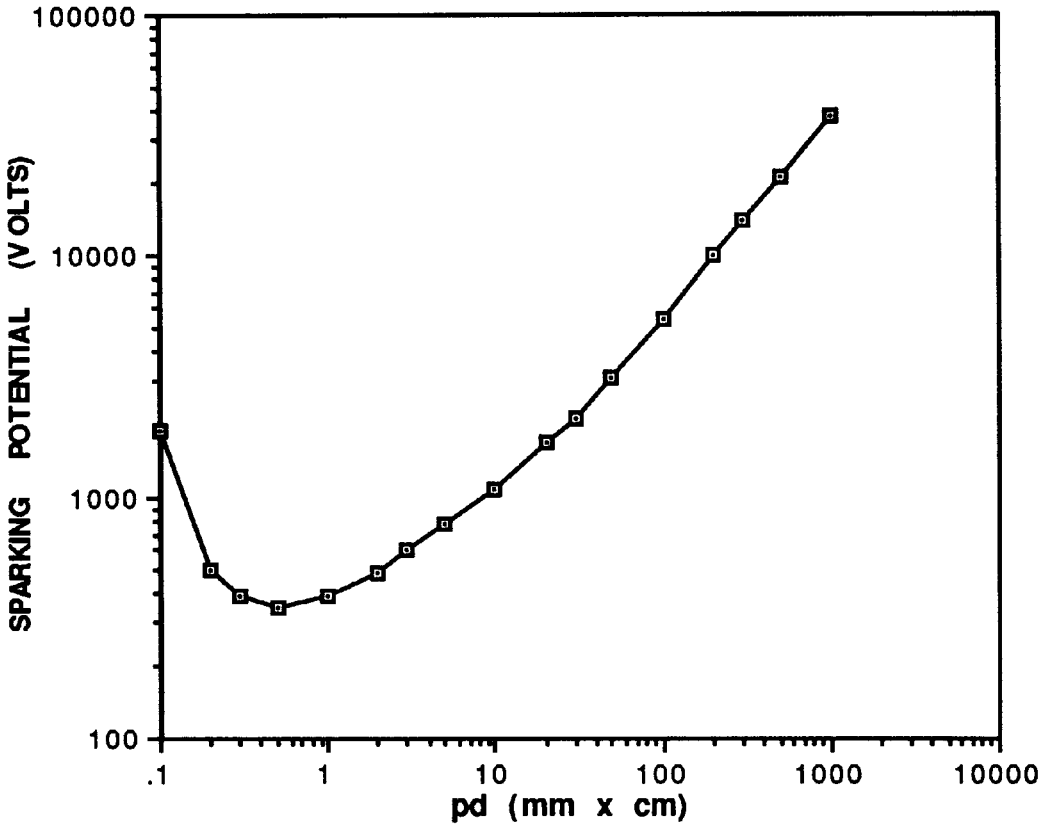
Fig. 5 Prior Art—Paschen's Law
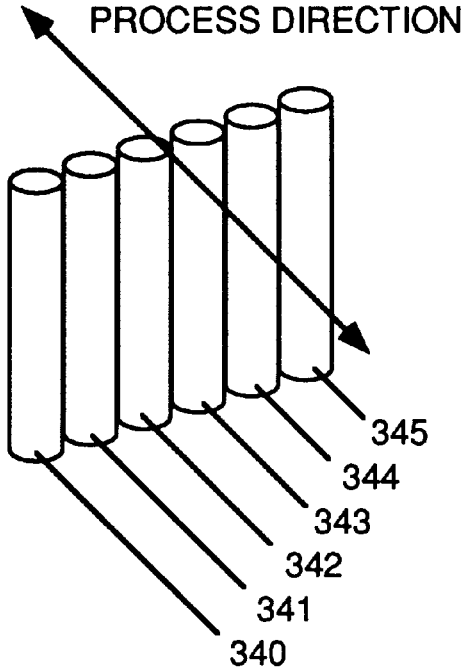
Fig. 6—Prior Art

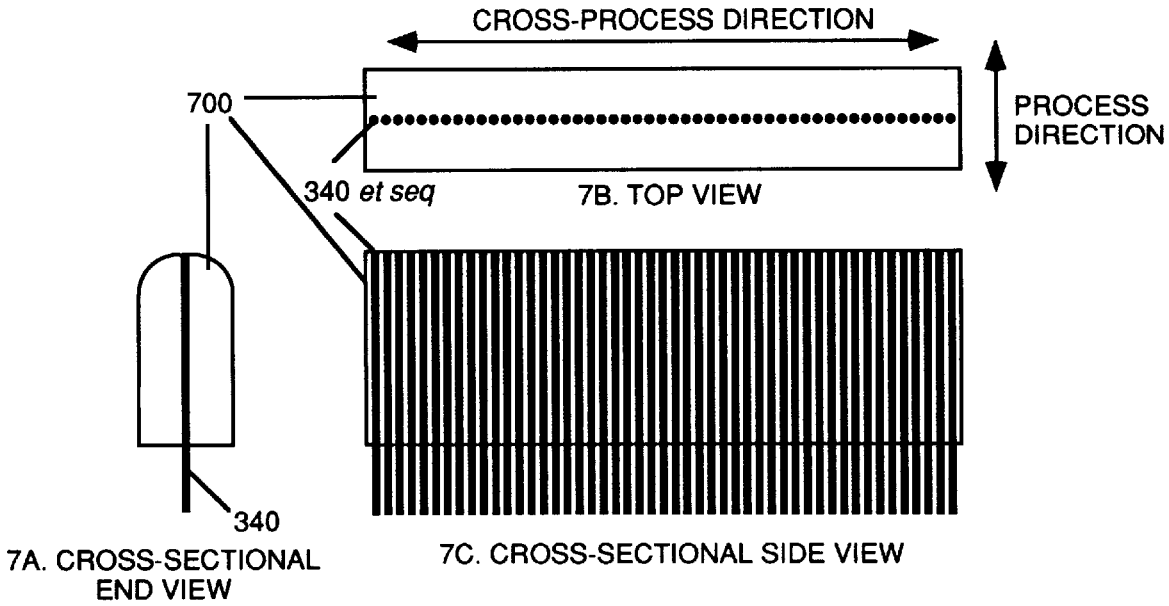
Figs. 7A-7C—Prior Art
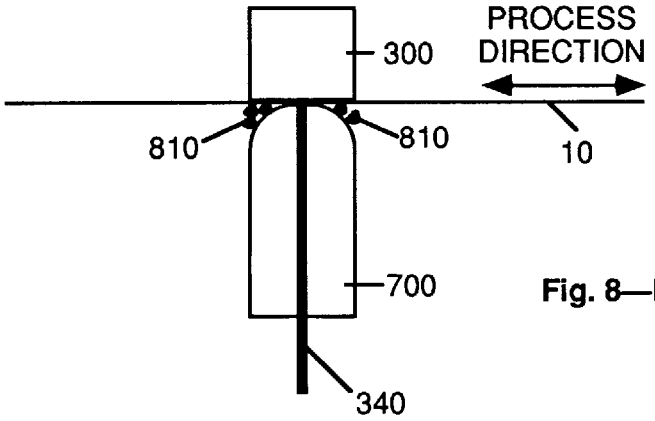
Fig. 8—Prior Art

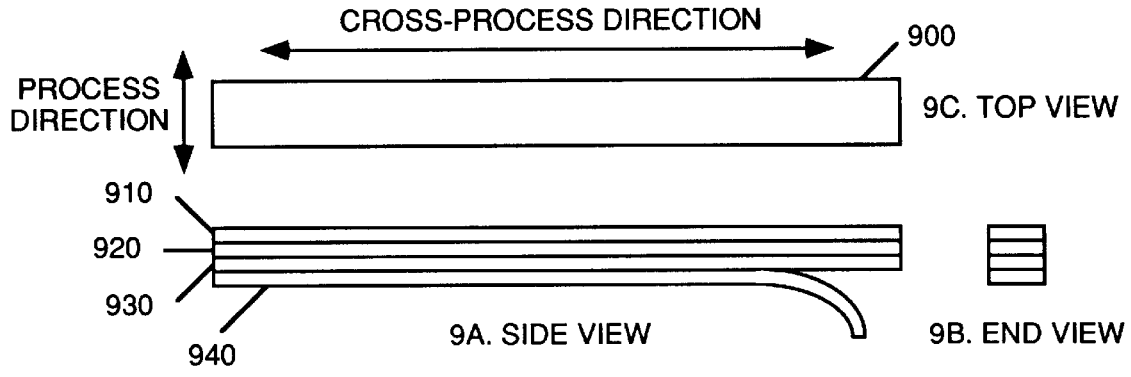
Figs. 9 (Not to Scale)
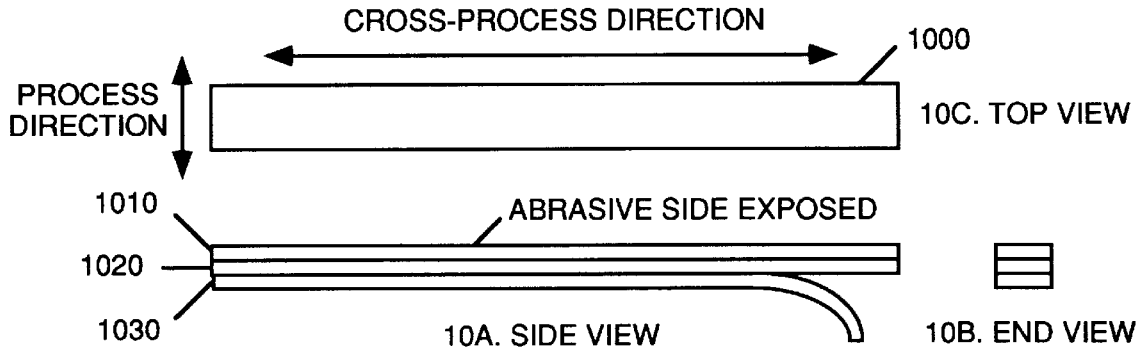
Figs. 10 (Not to Scale)

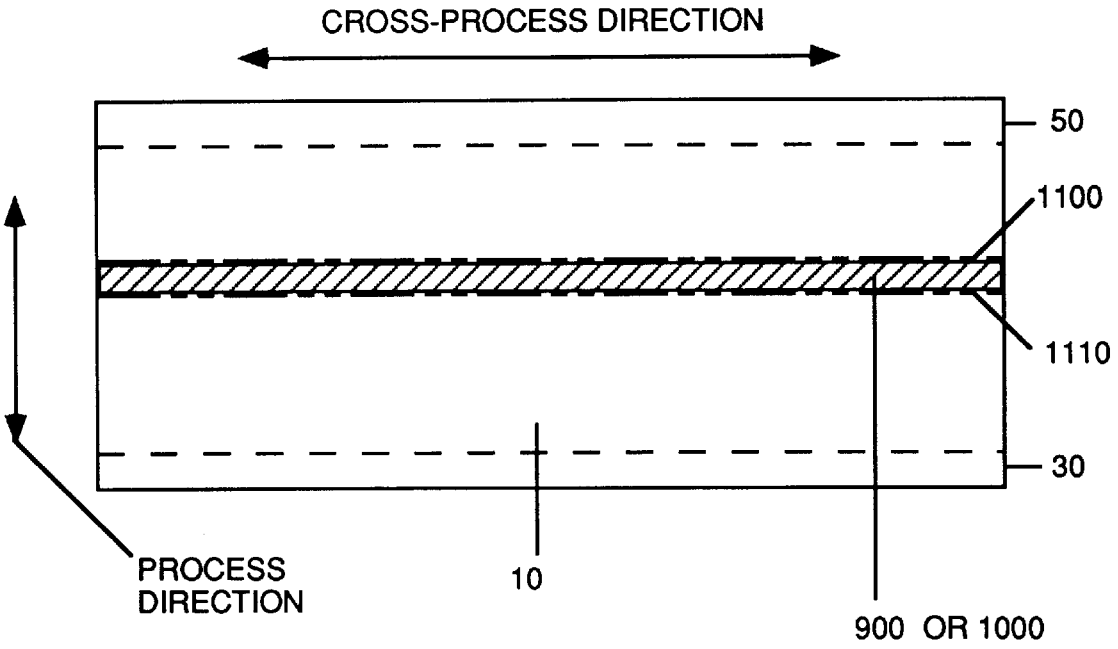
Fig. 11 (Not to Scale)

CLEANING AND LAPPING APPARATUS AND METHOD FOR ELECTROGRAPHIC PRINTERS

BACKGROUND

1. Field of Invention

This invention relates to the field of electrographic printing, also known as electrography. In electrographic printing, an invisible electrical charge image is deposited onto a receiving surface. This surface is then placed in contact with "toner" comprising a large number of small, colored particles. The toner adheres to the receiving surface in charged regions, and does not adhere to the surface in un-charged regions, thus rendering the electrical charge image visible. In particular, the instant invention teaches a method and apparatus for cleaning and lapping the surface of the writing head in an electrographic printer.

2. Prior-Art

Electrographic printers are manufactured and sold by Xerox ColorgrafX Systems, Inc., 5853 Rue Ferrari, San Jose, Calif. 95138 U.S.A., and others. These printers typically comprise a supply roll of electrographic medium, one or more electrographic writing heads, one or more "developing stations," a drive roller for moving the medium, and a take-up roller for spooling the medium after it is printed. The writing head deposits an electrical charge image on the medium, and the developing station applies "toner" to make the image visible.

The deposition and development of electrographic images by printers of the above type is well-understood by those skilled in the art of electrographic printing. These aspects of the electrographic printing process will not be described further except as they apply to the present invention.

Two modalities are commonly applied in electrographic printing of color images: multi-pass and single-pass printing.

Background—Prior-Art—Multi-Pass Printing—FIG. 1

A multi-pass printer 5 of the type sold by Xerox ColorgrafX Systems is shown schematically in FIG. 1. Printer 5 acts under instructions provided from its own internal memory (not shown) or from memory and programs stored in external computer 7. Medium 10 (electrographic paper, film, and the like) on which an image is to be printed is supplied on supply roll 20. In normal operation, medium 10 is pulled by drive roller 30 across writing head 40. Writing head 40, generally at a fixed distance from roller 30, deposits (or "writes") an electrostatic charge pattern generally comprising dots on the surface of medium 10 as medium 10 passes over the top surface of head 40. A "back electrode" 45 (discussed infra) springably forces medium 10 into intimate contact with head (40). In the case of front-writing printers (discussed infra) a pressure pad is used in lieu of electrode 45.

A restraining torque is applied to supply roll 20 by a motor (not shown). This torque maintains tension in medium 10 in the region between drive roller 30 and supply roll 20. This tension prevents wrinkling of medium 10 in this region. Similarly, an advancing torque is applied to take-up roller 50 by a motor (not shown). The tension from this torque prevents wrinkling of medium 10 in the region between drive roller 30 and take-up roller 50. The motion and position of any given location on medium 10 relative to rolls 20 and 50 is determined by the rotation of drive roller 30.

The electrostatic image on medium 10 is "developed" in well-known fashion by passing over a "toner" bath, provided by one of toner "fountains" 60, 70, 80, or 90. Toners comprise a slurry of sub-micron sized, electrically-charged, colored particles. Although four fountains are shown, electrographic printers may employ fewer or more than four, depending on the number of colors to be printed. In this method of printing, the primary colors cyan, magenta, yellow, and black are generally used. These colors are applied sequentially in "passes", normally in the order black-cyan-magenta-yellow.

Fountain 80 is shown in a raised position. It applies the black toner to the surface of medium 10. Black toner is generally supplied to fountain 80 by a pump (not shown). The toner is drawn from a reservoir (not shown), passes through fountain 80, and returns to the reservoir. The electrostatic image containing the pictorial information for the black printing pass comprises regions of one electrostatic charge (positive or negative). Toner particles of the opposite electrical charge adhere to image areas on medium 10 in proportion to the amount of charge present, in well-known fashion. After the first pass (typically black) has been printed and the image is rolled up onto take-up roll 50, the motion of medium 10 is stopped, then reversed. Medium 10 is re-wound onto supply roll 20 to a point preceding the start of the first image. Then the next color pass is printed. This process is repeated until all the desired color passes have been printed. During the printing process, internal components of the multi-pass printer become contaminated by accretions of dust, toner residue, print medium residue, and the like. These contaminants eventually reach a level beyond which print quality suffers. At this point, the printer must be opened and thoroughly cleaned. Revenue is lost during this printer "down time."

Prior-Art—Single-Pass Printing—FIG. 2

A single-pass printer 6 of the type sold by 3M Company, Minneapolis, MN, USA is shown schematically in FIG. 2. Printer 6 acts under instructions provided from its own internal memory (not shown) or from memory and programs stored in external computer 7. Medium 10 from supply roll 20 passes sequentially over a first electrostatic writing head 110, and a first toning fountain 120. This first writing and toning activity typically comprises the printing of the black primary color image. Medium 10 continues moving away from roll 20 and passes sequentially through writing and toning stations 130 through 180, respectively. Back electrodes or pressure pads (115) springably force medium 10 into intimate contact with the writing heads. Medium 20 passes over drive roller 30 on its way to take-up roll 50. In this printer configuration, the motion of medium 10 is typically, though not always, continuous and unidirectional. As with multi-pass printers, the internal components of single-pass printers also become contaminated with print medium residue, toner residue, dust, and the like. The printer must be stopped, opened, and thoroughly cleaned before printing can resume.

Prior-Art—Charge Deposition—FIGS. 3–8

In the prior-art configurations, the latent (undeveloped) electrostatic image is deposited on the top (receiving) surface of medium 10 by minute, electrostatic discharges at the surface of the medium. Two charge deposition or "writing" methods are typically used in the prior-art electrographic printer configurations described supra. The first method is known as "back writing." The second method is known as "front writing." The two methods are distinguished by their respective electrode configurations. Both cause equivalent electrical charges to be deposited on the surface of the medium. Therefore only back writing will be discussed in detail here. Refer to FIG. 3. A relatively large back electrode 300 is in contact with the back side of medium 10. Electrode

300 typically has a dimension of 1.0 inch (2.54 cm) in the medium motion (or "process") direction. The extent of electrode 300 in the transverse direction varies between about 0.5 inch (1 cm) and 54 inches (137 cm), depending on another configurational variant in the design of electrographic printers (not discussed here). A writing or "front" electrode 340 is typically made of a metal such as copper or nickel. Electrode 340 is typically supplied as a wire having a diameter of 0.003 inch (0.076 mm). Alternatively a printed circuit trace having cross-sectional dimensions of 0.0025 inch (0.064 mm) by 0.001 inch (0.025 mm) is used.

Medium 10 typically comprises at least two layers. A back layer 320 is typically 0.005 inch (0.13 mm) thick. It is made electrically conductive by the incorporation of certain additives (not discussed here). A front layer 330 is typically 0.0002 inch (5 microns) thick. Front layer 330 is an insulating, plastic material. Layer 330 is not soluble in the liquid toner which is applied by fountains 60–90 (FIG. 1) and 110–180 (FIG. 2).

When a potential difference on the order of 500 to 1,000 volts is applied between electrodes 300 and 340, an electrical discharge occurs beneath and in the vicinity of electrode 340. The discharge occurs preferentially at electrode 340 and not at electrode 300 for two reasons. The first reason is due to the difference in size between the two electrodes. The electric field gradient in the vicinity of the smaller electrode 340 is higher because of the difference in size between the two electrodes.

The second reason relates to the quality of the physical contact between electrodes 300 and 340 and their respective mating surfaces at the back side of back layer 320 and front side of front layer 330, respectively. Refer to FIG. 4. Back electrode 300 and back layer 320 are in intimate contact over a large area. The low electrical impedance associated with this large intimate contact area minimizes the possibility of electrical discharge on the back side of medium 10 when the writing voltage is applied. In contrast, front electrode 340 and front surface 330 are maintained in less-than-intimate contact by the presence of abrasive, pigment particles 400, typically titanium dioxide which are incorporated into layer 330 at the time of manufacture of medium 10.

Front surface 330 is typically 5 microns thick. Pigment particles 400 are typically 6 or 7 microns in diameter and thus project beyond the surface of layer 330 by a distance of approximately two microns. Particles 400 serve three purposes. The first is to add whitening to medium 10. The second is to continually abrade and clean the surface of electrode 340. The third purpose of pigment particles 400 is to provide a high-impedance air gap 410 between the external surface of insulating layer 330 and electrode 340.

The electrical discharge which occurs, preferably at gap 410, leaves image-wise, electrostatic charges on the surface of medium 10. This discharge occurs at a voltage value determined by Paschen's Law. According to Paschen's Law, the voltage at which a spark or discharge will occur between two parallel plate electrodes varies according to the plot shown in FIG. 5. The ordinate is the voltage at which discharge occurs. The abscissa is the product of pressure, p (mm Hg), and the distance between the electrodes, d (cm). In the present case, the exterior surface of layer 330 (FIG. 4) and the top of electrode 340 (FIG. 4) comprise the two electrodes. These electrodes are held apart by pigment particles 400 (FIG. 4) at a spacing of about two microns. At two microns and standard atmospheric pressure (760 mm Hg), the discharge voltage is approximately 500 volts. It was mentioned supra that layer 330 is an insulator. Yet it has also been regarded an electrode in the present discussion, which implies that it is a conductor. This apparent contradiction is resolved by the transient nature of the voltage applied to electrodes 300 and 340. In order to deposit image-wise charge dots as medium 10 moves, the writing voltage must be applied in the form of transient pulses. The rise time of these pulses is sufficiently short to render the capacitive reactance of layer 330 very small. Thus, for a brief period of time most of the potential difference between electrodes 300 and 340 appears in the air gap between the surface of layer 330 and electrode 340 and a discharge will occur. Note, by reference to FIG. 5, that very small differences in the spacing between layer 330 and electrode 340 result in significant changes in the voltage at which a discharge will occur. The importance of this fact becomes apparent infra.

In a typical electrographic printer, many writing electrodes 340 are placed side-by-side as shown in FIG. 6. Such an assemblage of electrodes 340 et seq. is called a writing "head." Each electrode is connected to a voltage source and, on demand, deposits charge on the external surface of layer 330, as described supra.

A writing head is shown in detail in FIG. 7. Electrodes 340 et seq. are typically embedded in an insulating, plastic material 700. This material provides mechanical support for the individual electrodes. A typical dimension of head 700 in the process direction is 1.0 inch (2.54 cm). A typical length of head 700 in a direction transverse to the process direction is 54 inches (137 cm).

FIG. 8 shows a cross-sectional view of head 700. Medium 10 is shown in contact with head 700. Intimate contact is maintained by back electrode 300, as described supra. During the writing process, static electrical charge is deposited on the surface of medium 10 as it moves over electrodes 340. As explained supra, the deposition of electrical charge is dependent on the maintenance of minute spacings between the lower surface of medium 10 and electrodes 340 in head 700. If these spacings are not accurately maintained across the width of head 700 (transverse to the process direction), varying voltages will be required to create the discharges which leave static electrical charge on the surface on medium 10. As a result of varying discharge voltages, varying amounts of current will be available for each discharge. This results in the deposition of varying amounts of charge on the surface of medium 10. Therefore the result of varying spacings is variations in density of the final print in the cross-process direction. These are normally called "striations," and in extreme cases "dropouts." Striations and dropouts can be sufficiently objectionable as to cause rejection of printing jobs. This in turn wastes valuable time and money.

Striations and dropouts caused by varying spacings are typically the result of uneven build-up of contaminants 810 on head 700. These contaminants arise from agglomerations of dust, dried toner, dislodged pigment particles, and the like. These agglomerations must be periodically removed in order to maintain print quality. To remove these deposits, the printer is stopped, resulting in a loss of productivity. The printer is opened and head 700 is manually scrubbed using a cloth or lint-free paper and a solvent, typically a kerosene-like synthetic hydrocarbon manufactured by Exxon Corporation, of Houston, Tex., U.S.A. and sold under the trademark Isopar. The printer is then closed, medium 10 is properly re-threaded, and production resumes.

This cleaning process is usually started after at least one printed image has been deemed unsatisfactory, resulting in wastage of at least one print. The cleaning process typically results in at least 10 minutes "down time," during which the printer is inactive and not generating revenue and the operator's attention is diverted from more productive activities. In some circumstances, the printer must be cleaned after each 50 feet (18 m) have been printed. This can result in a substantial and undesirable addition to production costs.

Occasionally, the buildup of deposits will cause head 700 to wear unevenly in the cross-process direction (perpendicular to the process direction in the plane of medium 10). Uneven wear can cause variations in discharge potential, as described supra. This, in turn, results in the presence of striations and dropouts. In order to return to normal print quality, head 700 must be "lapped." Again, the printer must be stopped and opened to expose head 700. A fine, abrasive is carefully rubbed across the top surface of head 700, in the cross-process direction. Frequently a lapping tool (not shown) is used to ensure that the surface is perfectly uniform after lapping. The lapping operation can take as long as 20 minutes. Although lapping is normally done in the cross-process direction, it is possible that lapping in this direction is inappropriate. Lapping in this direction removes the minute "wear-in" differences in height which normally occur when an abrasive medium (such as electrographic paper, film, etc.) passes between two surfaces which are sprung together, i.e. back electrode 300 (FIG. 8) and head 700 (FIG. 8). Lapping in the cross-process direction removes these variations and may actually contribute to the formation of striations and dropouts.

OBJECTS AND ADVANTAGES

Thus present electrographic printers suffer from numerous disadvantages, including a need for frequent cleaning and lapping with their associated costs and negative impact on productivity. Accordingly it is one object of this invention to provide improve a method and apparatus for cleaning the writing head in electrographic printers, providing improved electrographic printers. Other objects are to provide a cleaning method and apparatus which can be applied without significant loss of printing production time, a lapping method and apparatus which can be applied in a manner similar to the cleaning apparatus and method, cleaning and lapping maintenance methods and apparatus which can be applied without opening and unthreading the writing medium from the printer, and an improved lapping method in the process direction which will preserve the minute variations in height of the electrographic head, thus removing one cause of striations. Still further objects and advantages will become apparent from the ensuing description and drawings.

SUMMARY

In accordance with the present invention, a method and apparatus are provided which hasten and simplify the cleaning and lapping processes for electrographic printers. The method and apparatus are applied using the print medium to facilitate cleaning with the printer closed, thus removing the need to open and unthread the medium from the printer. The lapping method and apparatus have been observed actually to improve performance of the printer by lapping in the process direction. Results of the application of the instant methods and apparatus include at least more job throughput, improvements in print quality, and in production costs.

BRIEF DESCRIPTION OF THE DRAWINGS

FIG. 1 is a cross-sectional, schematic view of a prior-art, multi-pass electrographic printer.

FIG. 2 is a cross-sectional, schematic view of a prior-art, single-pass electrographic printer.

FIG. 3 is a prior-art electrode configuration.

FIGS. 4A and 4B are close-up views of a prior-art electrode configuration.

FIG. 5 is a prior-art plot showing discharge voltage vs. pressure and distance for parallel electrodes.

FIG. 6 is a schematic drawing of prior-art electrodes in an electrographic print head.

FIGS. 7A–7C are three views of a prior-art electrographic print head.

FIG. 8 is a close-up view of a prior-art print head showing contamination in the region between the print head and the print media.

FIG. 9 shows a preferred embodiment of a cleaning strip.

FIG. 10 shows a preferred embodiment of a lapping strip.

FIG. 11 shows a properly positioned cleaning or lapping strip.

DRAWING REFERENCE NUMERALS

Figure 12:
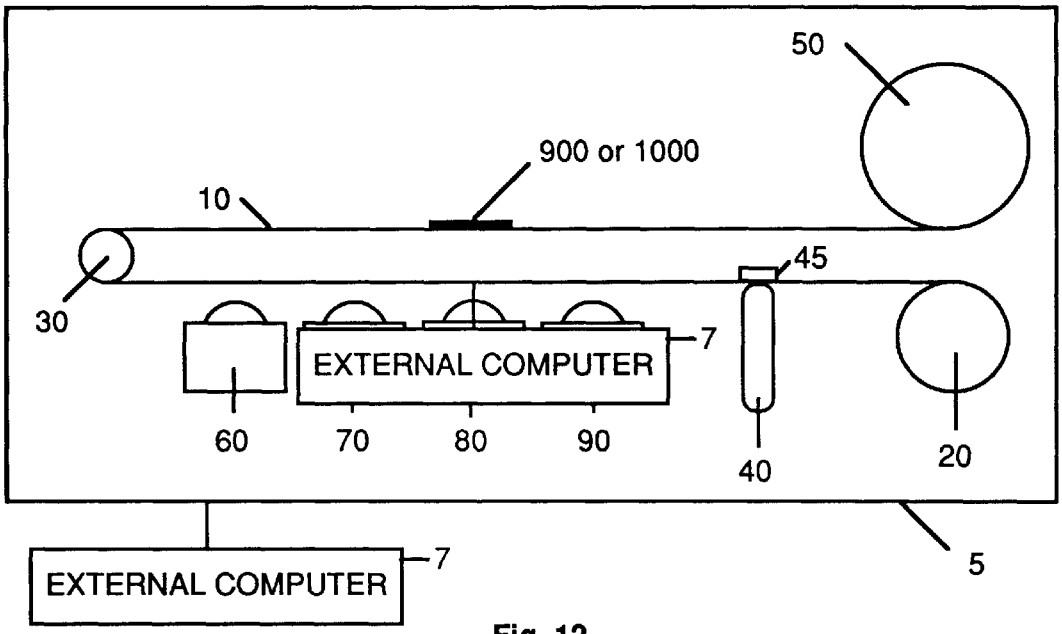
FIG. 12 shows the initial position of a cleaning or lapping strip in a multi-pass printer.

FIG. 1—Prior-Art
5 Multi-pass electrographic printer
10 Print medium
20 Medium supply roll
30 Drive roller
40 Writing head
45 Back electrode or pressure pad
50 Medium take-up roll
60 Toning station
70 Toning station
80 Toning station
90 Toning station
FIG. 2—Prior-Art
6 Single-pass electrographic printer
110 First writing head
115 Back electrodes or pressure pads
120 First toning station
130 Second writing head
140 Second toning station
150 Third writing head
160 Third toning station
170 Fourth writing head
180 Fourth toning station
FIG. 3—Prior-Art
300 Back electrode
320 Back side of medium
330 Front side of medium
340 Front, writing electrode
FIGS. 4A and 4B—Prior-Art
400 Pigment particles
410 Air gap
FIG. 6—Prior-Art
340–345 Assemblage of electrodes in a print head
FIGS. 7A–7C—Prior-Art
700 Print head FIG. 8—Prior-Art
810 Agglomerated debris
FIG. 9
900 Cleaning strip
910 Top layer of cleaning strip
920 Second, solvent barrier layer of cleaning strip
930 Third, adhesive layer of cleaning strip
940 Fourth, adhesive-protective kraft paper layer of cleaning strip
FIG. 10
1000 Lapping strip
1010 Top, abrasive layer of lapping strip
FIG. 11
1100 Fiducial line
1110 Fiducial line The Cleaning Strip—FIGS. 9A–9C

A cross-sectional view of one embodiment of a cleaning strip 900 used to clean the writing head in electrographic printers according to the instant invention is shown in FIG. 9. The dimension in the process direction is typically 4 inches (10.2 cm). In the cross-process direction, the dimension is typically between 24 and 54 inches (61 and 137 cm, respectively).

Strip 900 normally comprises several layers. The top layer 910 is typically an absorbent paper which does not dissociate or release paper fibers when it is wet. Plastic sponge or fiber mats can also be used. The thickness of this layer is generally 0.005 inch (0.013 cm).

The next layer 920, typically 0.001 inch (0.0025 cm) thick is firmly bonded to layer 910. Layer 920, typically polyethylene polymer, serves as a moisture barrier. Its function will be described further infra. The next layer 930 is an adhesive layer, typically 0.002 inch (0.005 cm) thick. Its function will also be discussed further infra.

The bottom layer 940 is a peel-away, kraft paper layer which protects the surface of adhesive layer 930 until the cleaning strip is used.

Layers 910 and 920 are available pre-assembled from Whatman International, Maidstone, England, under the mark Benchkote, Catalog Number 2300731. Layers 930 and 940 are available pre-assembled as product number F9460PC, manufactured and sold by Minnesota Mining and Manufacturing Company, Minneapolis, Minn., U.S.A. The two products are assembled by pressing them together in the order depicted in FIG. 9.

The Lapping Strip—FIG. 10

Exposure to the abrasive surface of medium 10 (FIG. 4) can cause uneven wear in the surface of head 700 (FIG. 7). Uneven wear can cause degradation of the printed image in as little as two hours of operation. Therefore, the head must be periodically lapped. A lapping strip 1000 is used in place of cleaning strip 900 (FIG. 9). Lapping strip 1000 has dimensions similar to cleaning strip 900 (FIG. 9). Lapping strip 1000 is assembled similarly to cleaning strip 900 (FIG. 9). However, layer 920 (FIG. 9) can be omitted since layer 1010, described infra, is typically moisture-impermeable. Layer 1010 is supplied as a fine abrasive on a plastic film substrate. One such abrasive is manufactured and sold by Minnesota Mining and Manufacturing Company, under the mark Imperial Lapping Film, part number 05114423933. Layers 930 and 940 are described supra. Layer 1010 is bonded to adhesive layer 930 with the abrasive side of layer 1010 exposed and the plastic side against layer 930.

Figure 13:
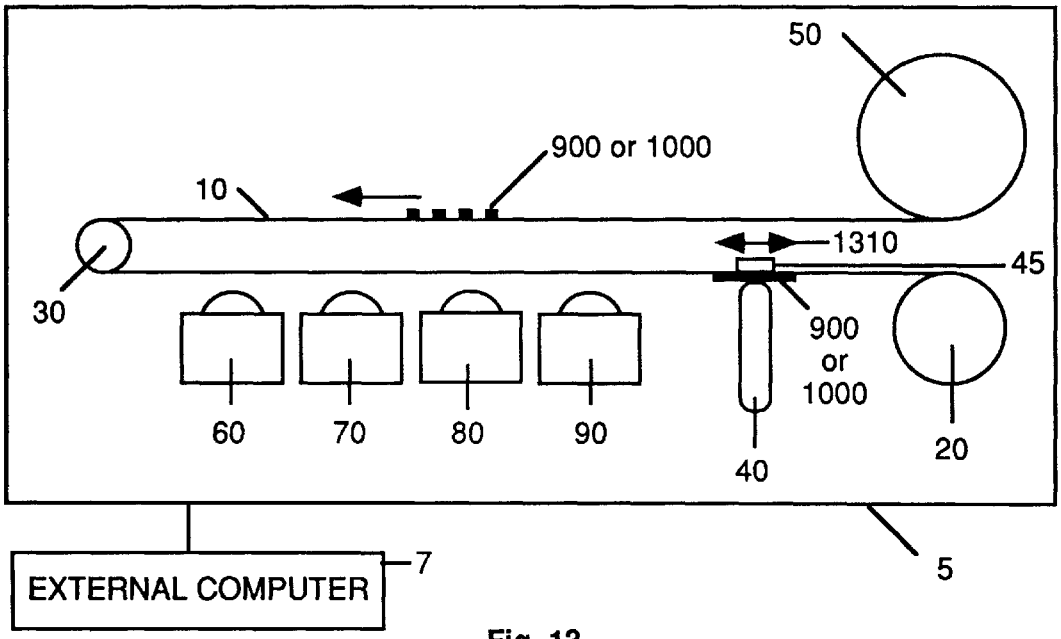
FIG. 13 shows the final position of a cleaning or lapping strip in a multi-pass printer.

Cleaning or Lapping the Electrographic Writing Head in a Multi-Pass Printer—FIGS. 11–13

The cleaning and lapping strips (900 and 1000 in FIGS. 9 and 10, respectively) are applied to the top surface of medium 10, as shown in FIG. 11. FIG. 11 is a view from the top-front side of printer 5 (FIG. 1) or 6 (FIG. 2). The portion of medium 10 which lies between drive roller 30 and take-up roll 50 is normally visible and accessible to the printer operator. The erect, printed image is visible from this vantage point. When the cleaning or lapping process is begun, two fiducial lines 1100 and 1110 are printed on medium 10. Instructions for printing these lines are pre-programmed and stored either in an external computer memory (not shown) or in the printer's internal memory (not shown). Medium 10 is then advanced in the process direction until these lines are approximately centered on top of the printer. The spacing between lines 1100 and 1110 is normally equal to or slightly greater than the width of cleaning strip 900 (FIG. 9) or lapping strip 1000 (FIG. 10). It is important for the printer operator to position the cleaning or lapping strip between these lines for reasons that will be discussed infra.

The decision when to apply a cleaning or lapping strip is made by the printer operator. It is based on a subjective judgment of print image quality. In most cases, a cleaning strip is used. When the operator determines that the print head (700, FIG. 8) requires lapping, then a lapping strip is applied.

In most cases, after the cleaning or lapping strip has been applied to medium 10, it is moistened with a liquid solvent, preferably the Isopar hydrocarbon described supra. This serves as a solvent for cleaning, and a lubricant for lapping. When the solvent is applied to cleaning strip 900 (FIG. 9), impermeable layer 920 (FIG. 9) prevents this solvent from reaching adhesive layer 930 (FIG. 9). If the solvent were to reach the adhesive layer, it could cause the adhesive to lose its tack, resulting in detachment of cleaning strip 900 (FIG. 9) from medium 10. Detachment is undesirable since this would cause fouling of the cleaning strip in the printer mechanism. When the solvent is applied to lapping strip 1000 (FIG. 10), the plastic film backing (described supra) of layer 1010 (FIG. 10) prevents attack of adhesive layer 930 (FIG. 10) by the solvent.

A side view of a prior-art, multi-pass printer with the instant invention installed is shown in FIG. 12. Cleaning or lapping strip (900 or 1000, respectively) has been applied to medium 10. Medium 10 is then moved from its initial position and rewound onto supply roll 20 until fiducial line 1110 (FIG. 11) reaches its final position at the tangent point of supply roll 20. When supply roll 20 is full, the distance between the center of head 40 and the point at which medium 10 is tangent to roll 20 is typically 4 inches (10.2 cm). Accurate placement of strip 900 (or 1000) is important since the above-described solvent must not contact the back side of medium 10. Solvent on the back side of medium 10 fouls other printer mechanisms (not shown) when medium 10 is again unwound.

When the cleaning strip or lapping strip is in place over print head 40, it can be moved back and forth over head 40, as indicated by arrows 1310 (FIG. 13). Pressure is applied to the back side of medium 10 by back electrode 45, thus forcing cleaning strip 900 (or lapping strip 1000) firmly into contact with the surface of head 40. Typically strip 900 (or 1000) is moved back and forth between one and 100 times, as detennined by the printer operator. The rate of this motion can be determined by the printer operator, but is typically one inch (2.54 cm) per second. While strip 900 (or 1000) is in contact with head 40, it is also possible to move head 40 in the cross-process direction (into and out of the page in FIG. 13). A typical speed in the cross-process direction is 0.25 inch (0.64 cm) per second. The medium and head motions can be performed simultaneously or sequentially.

After sufficient cleaning or lapping, medium 10 is advanced away from supply roll 20 toward take-up roll 50 until strip 900 (or 1000) is past head 40. Medium 10 wipes away any solvent and dislodged debris from head 40 as it advances toward take-up roll 50. When strip 900 (1000) has moved approximately six inches (15.2 cm) away from head 40 in the direction of roller 30, the cleaning process is complete, and the printer is ready to print the next image. The strip is rolled onto take-up roll 50 and discarded later.

Figure 14:
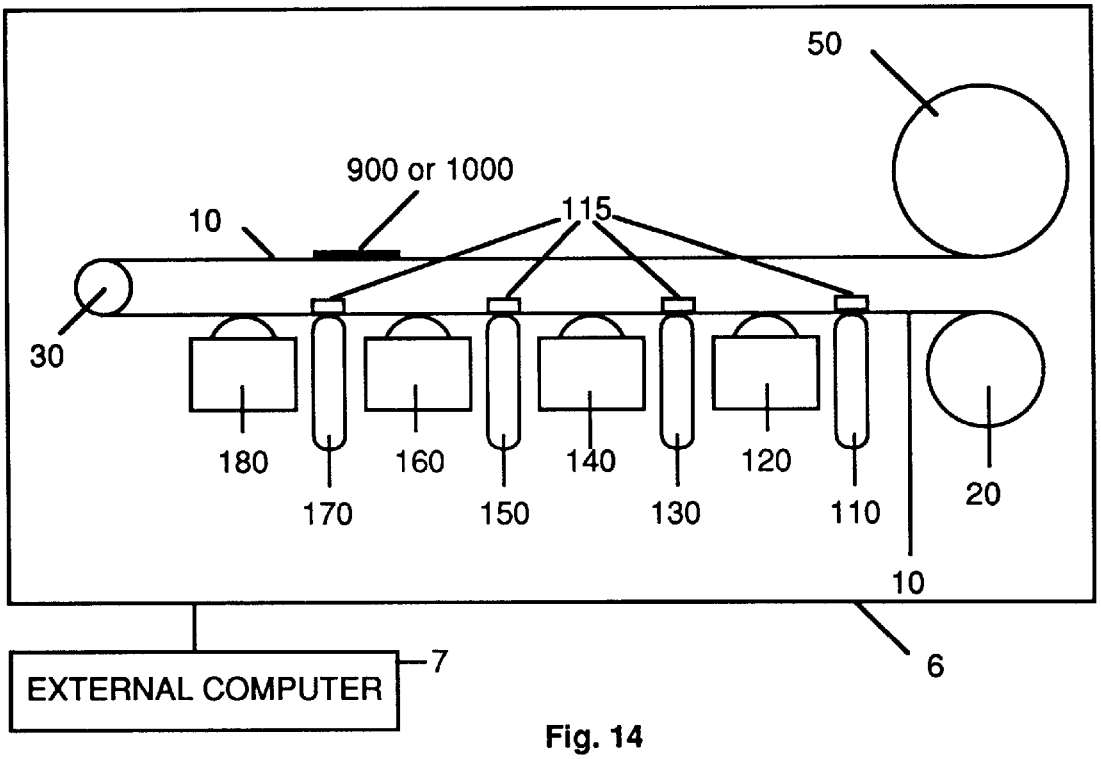
FIG. 14 shows the initial position of a cleaning or lapping strip in a single-pass printer.
Figure 15:
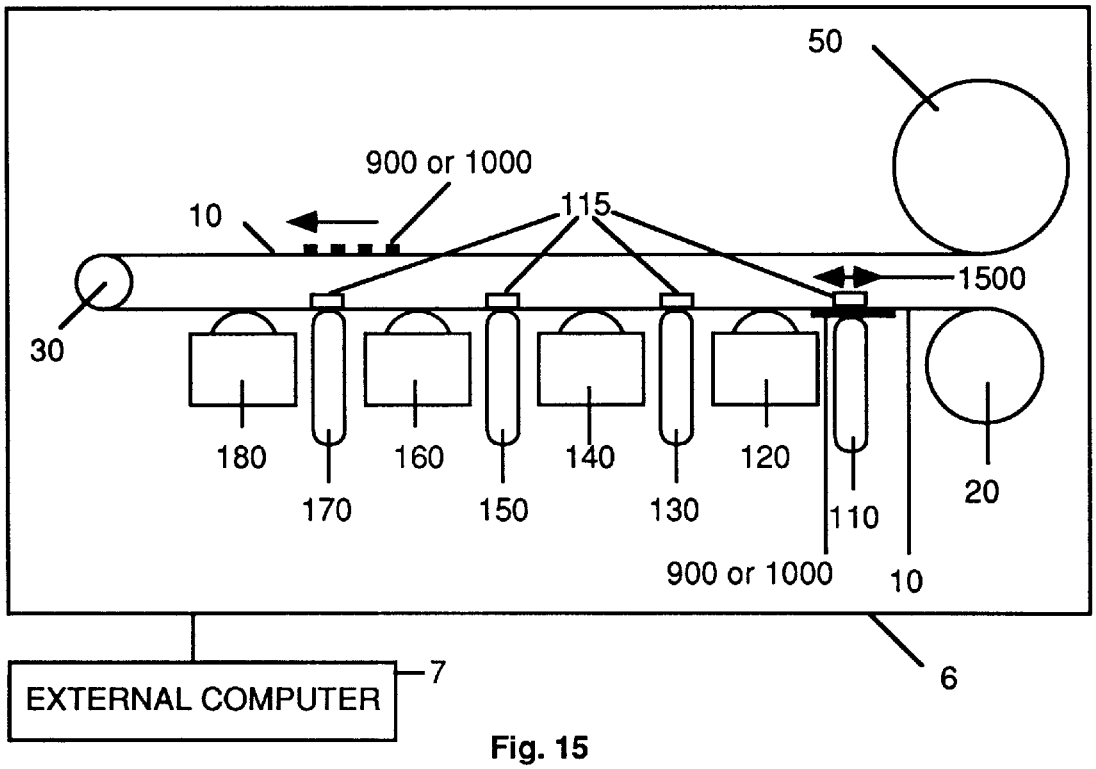
FIG. 15 shows the final position of a cleaning or lapping strip in a single-pass printer.

Cleaning or Lapping the Electrographic Writing Head in a Single-Pass Printer—FIGS. 14–15

When viewed externally, multi-pass and single-pass printers appear much the same. Therefore, location of the cleaning or lapping strip is performed the same way as shown in FIG. 11, supra. Fiducial lines 1100 and 1110 are printed, then moved to the top surface of printer 6. Cleaning or lapping strip 900 or 1000 is then applied to medium 10 and moistened with solvent, if desired. Medium 10 is then rewound until cleaning or lapping strip 900 (or 1000) is in the vicinity of first head 110. Process (1500) and cross-process (into and out of page) direction lapping and cleaning motions are applied at the first head. Then medium 10 is advanced until strip 900 (or 1000) is located in the vicinity of the second head 130, where cleaning or lapping is done. The process is repeated for heads 150 and 170, completing the cleaning or lapping operation. At this point, medium 10 is advanced further until strip 900 (or 1000) is away from head 170 in the direction of take-up roll 200. Printing then resumes.

In all cases, cleaning or lapping strip 900 (or 1000) is wound onto take-up roll 200 (FIG. 15) after use. It is discarded with the "chad" or unused medium which normally lies between successive prints.

Figure 16:
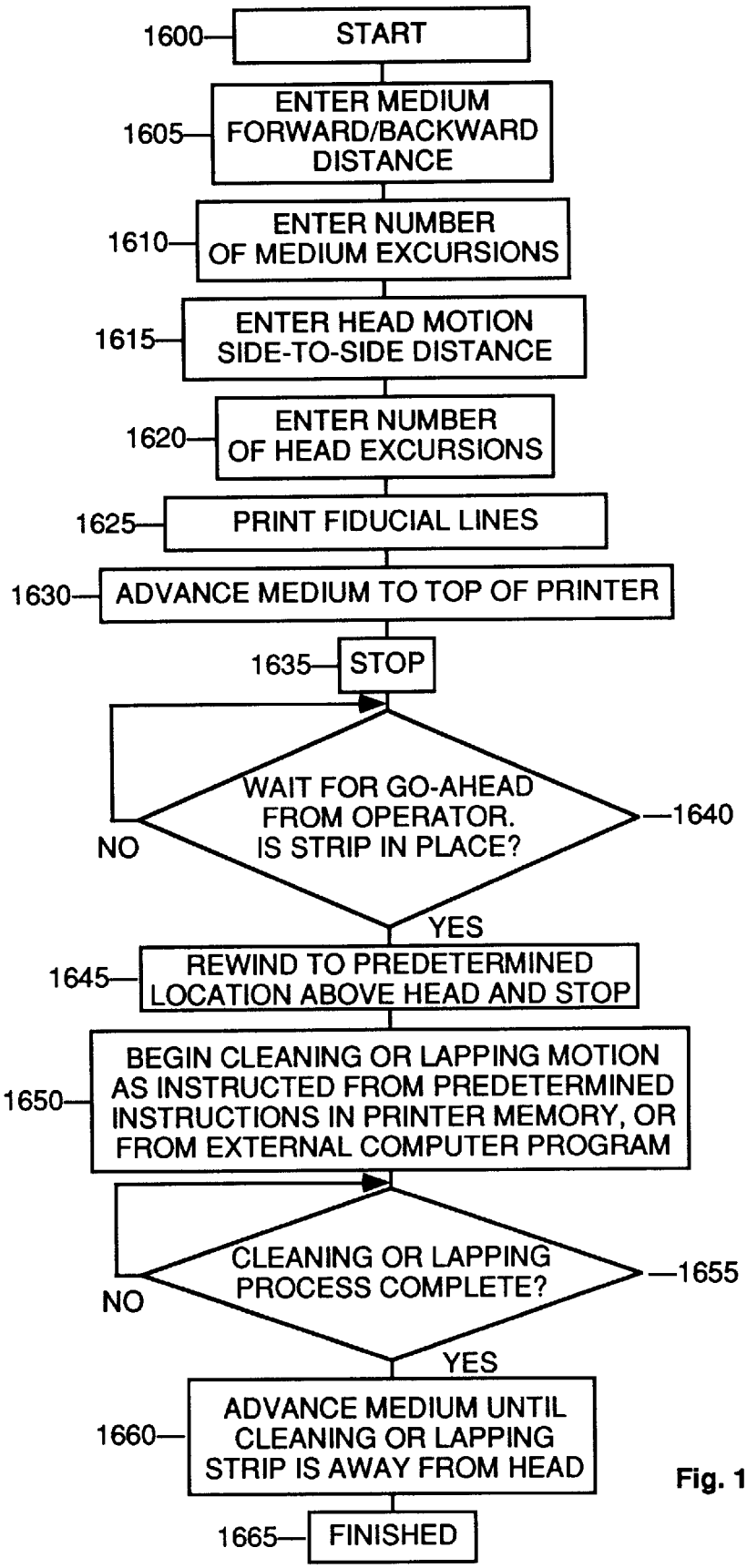
FIG. 16 is a block diagram showing steps in the cleaning or lapping process in a multi-pass printer.

Block Diagram of Cleaning Procedure—Multi-Pass Printer—FIG. 16

Instructions for performing the cleaning or lapping procedure are preferably supplied by the printer operator. They may be stored in the printer's internal memory (not shown) or in an external computer program (not shown). Both of these elements are common to all electrographic printers of the types discussed herein. They are also familiar to both designers and operators of these printers. The same procedure is followed whether the instructions are stored in the printer's memory or in an external computer's memory.

First, the operator instructs the printer or computer to start accepting instructions for performing a cleaning or lapping sequence block (1600). The medium normally moves forward and backward some distance during cleaning or lapping. This value is entered block (1605). This distance is typically between zero and ±2 inches (±5.1 cm).

Next, the number of excursions of the cleaning or lapping strip across the print head is entered block (1610). This number typically lies between one and 100.

Next, the cross-process-direction head motion distance is entered block (1615). This distance is typically ±0.5 inch (1.3 cm). The number of head excursions-typically between 1 and 100—is entered block (1620).

Next block (1625), the printer is instructed to print fiducial lines 1100 and 1110 (FIG. 11). After these lines are printed block (1625), they are advanced to the top surface of the printer block (1630), as explained supra. The medium motion then stops block (1635). At this point, the operator applies the cleaning or lapping strip to the medium, in the space between the two fiducial lines.

When the operator signals the printer that the strip is in place block (1640), the printer then rewinds the medium so that the strip is positioned above the writing head 40 (FIG. 10), as explained supra. Next block (1650), the printer commences moving the medium and the print head according to the previously entered instructions.

This process continues until the cleaning or lapping process is complete block (1655). After cleaning or lapping, medium 10 is advanced typically 12 inches (30.5 cm), moving the cleaning or lapping strip away from the print head block (1660). At this point, the cleaning or lapping process is finished block (1665) and normal printing can resume.

Figure 17:
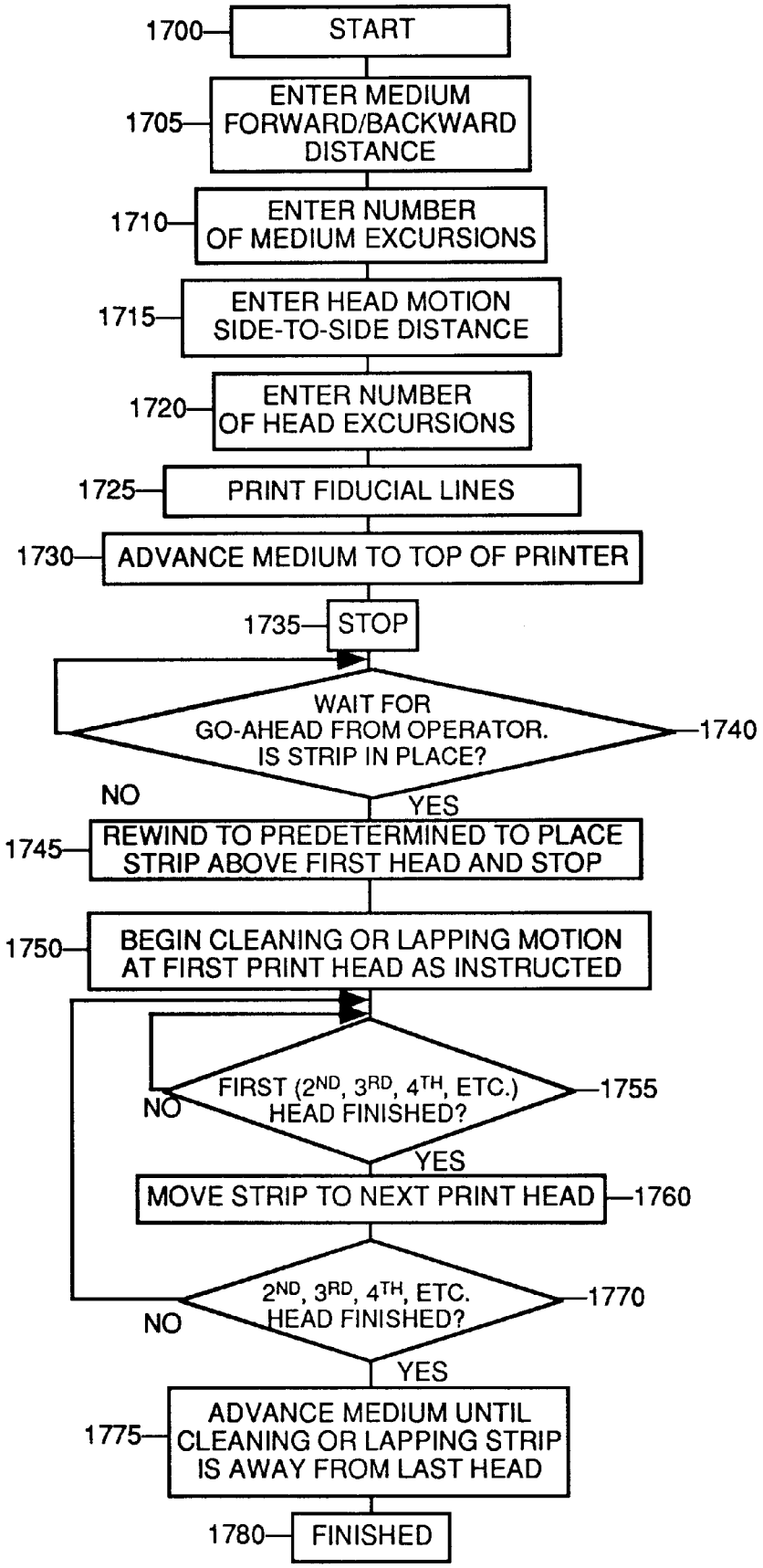
FIG. 17 is a block diagram showing steps in the cleaning or lapping process in a single-pass printer.

Block Diagram of Cleaning Procedure—Single-Pass Printer—FIG. 17

Instructions for performing the cleaning or lapping procedure are supplied by the printer operator. Instructions for the single-pass printer are entered similarly to those for the multi-pass printer. Each of the multiple print heads can be cleaned or lapped in the same way, or separate data can be entered for each head. For example, the operator may wish to omit cleaning of one particular head, preferring to clean only the remaining heads. This level of detail is not described herein. Only the simplest case is considered.

First, the operator instructs the printer or computer to begin accepting instructions for performing a cleaning or lapping sequence block (1700). Next the medium forward-backward distance is entered block (1705). Then the number of strip excursions at each head is entered block (1710). Next the side-to-side motion distance is entered block (1715). Finally, the number of side-to-side (cross-process direction) head excursions for each head is entered block (1720). Fiducial lines 1100 and 1110 (FIG. 11) are printed block (1725), and medium 10 is advanced to the top of the printer block (1730), where the motion of medium 10 is stopped block (1735). The operator now applies the cleaning or lapping strip to medium 10 between lines 1100 and 1110 (FIG. 11) and signals the printer (or computer) block (1740) that the strip is in place. Medium 10 is then rewound to a location over the first print head, where it stops block (1745). Cleaning or lapping motions commence, as instructed block (1750). These motions continue until cleaning or lapping of the first head is complete block (1755). Medium 10 then advances, moving the strip to the next print head to be cleaned or lapped block (1760). When the last head is finished block (1770), medium 10 is advanced block (1775) until the strip is away from the last head cleaned. At this point, the procedure is finished block (1780).

Summary, Ramifications, and Scope

Thus the instant invention solves numerous problems associated with prior-art electrographic printers. Re-threading the prior-art printer normally wastes between 3 and 6 feet (0.9 and 1.8 meter) of print medium. A cleaning or lapping operation in the prior-art printer normally takes between 5 and 30 minutes. With the instant invention, it is no longer necessary to unthread and open a printer to periodically clean or lap its print head. Medium wastage and downtime are reduced, resulting in lowered labor and overhead costs. Printing production rate and print quality are increased, resulting in higher profits. This novel cleaning and lapping method and apparatus is useful for single-pass and multi-pass electrographic printers. This method is relatively quick and inexpensive to apply when compared with the labor and production cost involved in prior-art cleaning and lapping techniques. The printer need not be opened during this process. Much of the material removed from the head during cleaning or lapping remains on the cleaning or lapping strip and is wound onto the take-up roll and is later discarded.

While the above description contains many specificities and a presently preferred embodiment, the invention is not limited to these and can take other forms and arrangements. For example, in addition to applying solvents for cleaning, the user can apply "conditioning agents" to the cleaning or lapping strip and have them delivered to the printer's writing head. These agents include silicone greases, and various cleaning and grinding compounds.

Lapping of the print head can be accomplished in the process direction, or the cross-process direction, or both. This gives the operator extra flexibility in determining the proper contour of the print head. Lapping in the process direction "wears in" the head in response to varying pressure along the length (in the cross-process direction) of the back electrode. Lapping in the cross-process direction tends to form a flatter contour on the head since pressure is applied by both hills and valleys in the back electrode. Lapping in both directions provides an average of the results obtained from each.

Although cleaning and lapping are generally applied to the electrographic print head, they can also be applied to the rollers in toner applicators (e.g. 60 through 90 in FIG. 1, and 120, 140, 160, and 180 in FIG. 2). In this application, the strip would be held more-or-less stationary while the rotors in the toner applicators rotate, in well-known fashion.

The cleaning and lapping strips may be wider or narrower in the process direction or in the cross-process direction. Instead of having straight borders, they may have wavy or angular borders. Instead of being rectangular in shape, they may be elliptical.

Rather than applying the strip parallel to the cross-process direction, it may be applied at an angle. Rather than using a single strip, multiple strips may be used at the same time.

The thicknesses of the various layers comprising the strips may vary. For example, the various layers may be thicker or thinner than described.

Other solvents may be used. These can include ethanol, methanol, kerosene, water, and the like which are compatible with the printer's internal components.

A stain or dye may be applied to the cleaning or lapping strip. This would be used to diagnose the condition of the head by finding pits and valleys in the head surface.

A cleaning and lapping strip may be combined so that part of the strip is capable of lapping the print head, while the other part of the strip cleans it.

While the present system employs elements which are well known to those skilled in the separate arts of cleaning, lapping, printing, and printer control, it combines elements from these fields in a novel way which produces a new result not heretofore discovered.

Accordingly the scope of this invention should be determined, not by the embodiments illustrated, but by the appended claims and their legal equivalents.

I claim:

1. A method for cleaning and lapping at least one electrographic print head in an electrographic printer of the type which can move a medium, comprising:

a. printing at least one fiducial mark on a medium, b. applying a strip to said medium in the vicinity of said fiducial mark, c. instructing said printer to move said medium so that said strip moves to the location of said print head, and d. causing said printer to move said medium containing said strip back and forth a first predetermined distance for a first predetermined number of times adjacent said print head.

2. The method of claim 1 wherein said printer is arranged to move said print head back and forth a second predetermined distance for a second predetermined number of times.

3. The method of claim 1 wherein said strip is selected from the group consisting of cleaning strips and lapping strips.

4. The method of claim 1 wherein said instructions are stored in an external computer.

5. The method of claim 1 wherein said instructions are stored in said printer.

6. The method of claim 1 wherein said printer is a multi-pass printer.

7. The method of claim 1 wherein said printer is a single-pass printer.

8. A system for cleaning and lapping at least one print head in an electrographic printer which prints on a medium, comprising:

a. an electrographic printer which has a movable print head and which prints electrographically on a medium which moves with respect to said print head, b. a medium which can be printed on by said electrographic printer, c. said medium, having a cleaning or lapping strip thereon, said cleaning or lapping strip being positionable on said medium, and d. a memory which stores instructions for positioning and moving said cleaning or lapping strip and said print head so that they rub against each other so as to clean or lap said print head when said medium and said print head move with respect to each other.

9. The system of claim 8 wherein said printer is arranged to print at least one fiducial mark onto said medium to enable said strip to be positioned accurately on said medium.

10. The system of claim 9 wherein said strip is positioned adjacent said fiducial mark on said medium.

11. The system of claim 8 wherein said memory is contained in said printer.

12. The system of claim 8 wherein said memory is contained in an external computer.

13. A system for cleaning and lapping at least one print head in an electrographic printer, comprising:

a. a printer which can print electrographically on a medium b. first means for storing printer commands, said printer being responsive to said commands, c. second means for moving said medium and said print head within said printer with respect to each other, and d. third means for cleaning and lapping said print head in said electropraphic printer in response to said commands.

14. The system of claim 13 wherein said first means for storing and executing printer commands is contained in said printer.

15. The system of claim 13 wherein said first means for storing and executing printer commands is contained in an external computer.

16. The system of claim 13 wherein said second means moves said medium a predetermined distance for a predetermined number of times.

17. The system of claim 13 wherein said second means moves said print head a predetermined distance for a predetermined number of times.

18. The system of claim 13 wherein said printer contains a movable print head.

19. The system of claim 18 wherein said print head is caused to move in response to said commands.

20. The system of claim 13 wherein said third means comprises a cleaning strip.

21. The system of claim 13 wherein said third means comprises a lapping strip.

* * * * *